United States Patent [19]

Atsumi et al.

[11] Patent Number: 4,556,780

[45] Date of Patent: Dec. 3, 1985

[54] CERAMIC HEATER

[75] Inventors: Morihiro Atsumi; Hitoshi Yoshida, both of Okazaki; Nobuei Ito, Nukata; Kinya Atsumi, Toyohashi, all of Japan

[73] Assignees: Nippondenso Co., Ltd., Kariya; Nippon Soken, Inc., Nishio, both of Japan

[21] Appl. No.: 659,959

[22] Filed: Oct. 11, 1984

[30] Foreign Application Priority Data

Oct. 17, 1983 [JP] Japan ..... 58-194696
May 7, 1984 [JP] Japan ..... 59-91668

[51] Int. Cl.[4] ..... F23Q 7/22

[52] U.S. Cl. ..... 219/270; 123/145 A; 219/260; 219/544; 219/553; 252/520; 338/326; 361/266

[58] Field of Search ..... 219/260, 267, 270, 523, 219/541, 544, 553; 123/145 R, 145 A; 361/264, 266; 252/507, 513, 51 B, 520; 338/326, 330

[56] References Cited

U.S. PATENT DOCUMENTS

| | | | |
|---|---|---|---|
| 4,357,526 | 11/1982 | Yamamoto et al. | 219/544 |
| 4,401,065 | 8/1983 | Minigishi et al. | 123/145 A |
| 4,449,039 | 5/1984 | Fukazawa et al. | 219/553 |
| 4,458,637 | 7/1984 | Minigishi et al. | 123/145 A |
| 4,475,029 | 10/1984 | Yoshida et al. | 219/270 |
| 4,486,651 | 12/1984 | Atsumi et al. | 219/553 |
| 4,499,366 | 2/1985 | Yoshida et al. | 219/270 |

*Primary Examiner*—Volodymyr Y. Mayewsky
*Attorney, Agent, or Firm*—Cushman, Darby & Cushman

[57] ABSTRACT

A ceramic heater comprises a heat generator made of a conductive ceramic sintered body, a supporter made of an insulating ceramic sintered body for supporting the heat generator, and a metallic wire for supplying an electric current from an electrode to the heat generator. The heat generator is integrally covered with an unporous covering layer made of an insulating ceramic sintered body. The covering layer prevents the heat generator from being directly exposed to oil and water. The covering layer is made of, for example $Si_3N_4$ or glass containing $SiO_2$ as a main constituent into a thickness of not more than 1mm.

14 Claims, 8 Drawing Figures

CERAMIC HEATER

BACKGROUND OF THE INVENTION

The present invention relates to a ceramic heater, for example a ceramic heater to be used in a glow plug for a diesel engine.

Recently, a ceramic heater provided with a heat generator made of a conductive ceramic sintered body, has been proposed. However, this ceramic heater has a problem that minute cracks are produced in the heat generator while being used under such a condition as being exposed to low temperature liquid such as water and oil.

The ceramic heater can be used as a heater of a diesel engine because the heat generator is of a simple construction and has excellent quick heating property. In this case, the heat generator generates heat of about 1300° C. When the high temperature heat generator is exposed to light oil as a fuel, minute cracks are produced in the heat generator so as to increase the resistance thereof.

SUMMARY OF THE INVENTION

One object of the present invention is to provide a ceramic heater which has excellent thermal shock resistance and is free from the occurrence of cracks when being exposed to water and oil.

Another object of the present invention is to provide a quick-heating and durable ceramic heater suitable for a heater of a glow plug of a diesel engine.

The ceramic heater of the present invention is composed of a heat generator made of a conductive ceramic sintered body, a supporter made of an insulating ceramic sintered body for supporting the heat generator, electric current supply means for supplying an electric current to the heat generator and a covering layer made of an unporous ceramic sintered body for covering the heat generator.

The conductive ceramic for forming the heat generator is for example molybdenum dicilicide($MoSi_2$), titanium carbide(TiC) and titanium nitride(TiN). In addition, a ceramic sintered body made of a mixture of the above described conductive ceramic and silicon nitride($Si_3N_4$) or alumina($Al_2O_3$), can be used.

Molybdenum dicilicate is superior in conductivity and oxidation resistance so as to be a preferable material as the ceramic heat generator.

The addition of $Si_3N_4$ to $MoSi_2$ imparts thermal shock resistance to the heat generator.

The composition ratio of $Si_3N_4$ is 50 to 95 mol %, preferably 50 to 70 mol%. The composition ratio is determined mainly by the electric resistance of the heat generator to be produced. For example, in order to make the heat generator generate heat most effectively when a battery of an automobile of which the rated voltage is 12 V and 24 V is used as an electric power source thereof, the preferable composition ratio of $Si_3N_4$ is about 70 mol%.

The covering layer is made of a sintered body of an insulating ceramic such as silicon nitride($Si_3N_4$), silicon carbide(SiC), zirconium oxide($ZrO_2$), and boron nitride(BN). In addition, the mixture of the above described insulating ceramic and alumina($Al_2O_3$) can be also used.

One of the above described insulating ceramics is selected in accordance with the coefficient of thermal expansion of the heat generator. Namely, insulating ceramic having a coefficient of thermal expansion, which is close to that of the heat generator, is selected from the above described ceramics.

In addition, glass containing silicon dioxide($SiO_2$) as a main constituent can be used as the material of the covering layer. In this case, the glass containing not less than 95 mol% of silicon dioxide is preferable.

As the thickness of the covering layer decreases, the cracks become liable to be produced. In the covering layer of which the thickness is too large, it takes a long period of time to raise the temperature of the surface of the covering layer to a predetermined temperature.

So, the quick-heating property of the heat generator is reduced.

The most preferable thickness of the covering layer depends on the material thereof but is about 1 mm or less.

The covering layer is provided to prevent the heat generator from being directly exposed to water and oil. Therefore, it is required to make the covering layer of unporous body through which water and oil do not infiltrate. The porosity of the covering layer is not more than 5%, preferably not more than 2%.

The supporter for supporting the heat generator is made of the insulating ceramic sintered body. For example, a sintered body of $Si_3N_4$ or a mixture of $Si_3N_4$ and $Al_2O_3$ is used. The heat generator and the supporter is joined to each other by integrally sintering two bodies.

The heat generator is connected to an electric power source by means of a lead wire. The lead wire is preferably embedded within the supporter.

DETAILED DESCRIPTION OF THE EMBODIMENTS

Hereinafter, the present invention will be explained in detail in accordance with the embodiments wherein the present invention is applied to the glow plug for a diesel engine.

Figure 1:
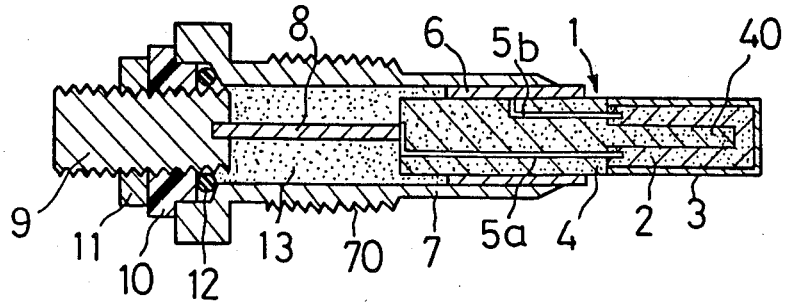
FIG. 1 is a sectional view of a glow plug wherein a ceramic heater according to the present invention is employed.

FIG. 1 illustrates a glow plug for a diesel engine.

In FIG. 1, a heater element 1 comprises a ceramic heat generator 2, a ceramic covering layer 3 covering the heat generator 2, a ceramic supporter 4 supporting the heat generator 2 on a top end thereof, and metallic lead wires 5*a*, 5*b* of which one end is connected to the heat generator 2, respectively.

The heat generator 2 has a letter U shaped cross section, and a projecting portion 40 of one end of the supporter 4 is inserted into the center of the heat generator 2.

A metallic sleeve 6 is attached to the outer periphery of the supporter 4 and one end of a cylindrical metallic housing 7 is attached to the outer periphery of the sleeve 6. The sleeve 6 is soldered to a metallized layer formed in the outer periphery of the supporter 4 while the housing 7 is joined to the sleeve 6 by soldering.

A center electrode 9 is attached to the other open end of the housing 7 through an insulating bush 10. The bush 10 and the center electrode 9 are fixed to the housing 7 by means of a knut 11. And O ring 12 is disposed between the bush 10 and the housing 7 for sealing therebetween.

The other end of the lead wire 5*b* is connected to the housing 7 through the sleeve 6 while the other end of the lead wire 5*a* is connected to the center electrode 9 through a holding pin 8.

Insulating material powder such as magnesium oxide (MgO) powder is charged within the housing 7 around the holding pin 8.

The glow plug having the above described structure is inserted into a screw hole (not shown) formed in a wall of an engine combustion chamber (not shown) and fixed thereto by a screw 70 formed on the outer periphery of the housing 7.

In operation, when an electric voltage is applied between the center electrode 9 and the housing 7, an electric current flows passing the holding pin 8, the lead wire 5*a*, the ceramic heat generator 2, the lead wire 5*b* and the sleeve 6, consequently, the ceramic heat generator 2 generates heat.

Hereinafter, one example of the producing method of a first embodiment of the heater element 1 will be explained with reference to FIG. 2.

A plurality of insulating ceramic sheets 4C are prepared by mixing 62 mol% of $Si_3N_4$ with 38 mol% of $Al_2O_3$, adding polyvinyl biphenyl as an organic binder to the obtained mixture and processing the mixture with polyvinyl biphenyl by doctor blade method.

A plurality of conductive ceramic sheets 2*c* are prepared from the mixture of 30 mol% of $MoSi_2$ (average particle diameter: 0.9$\mu$) and 70 mol% of $Si_3N_4$ (average particle diameter: 35$\mu$) by the same method as described above.

Figure 2:
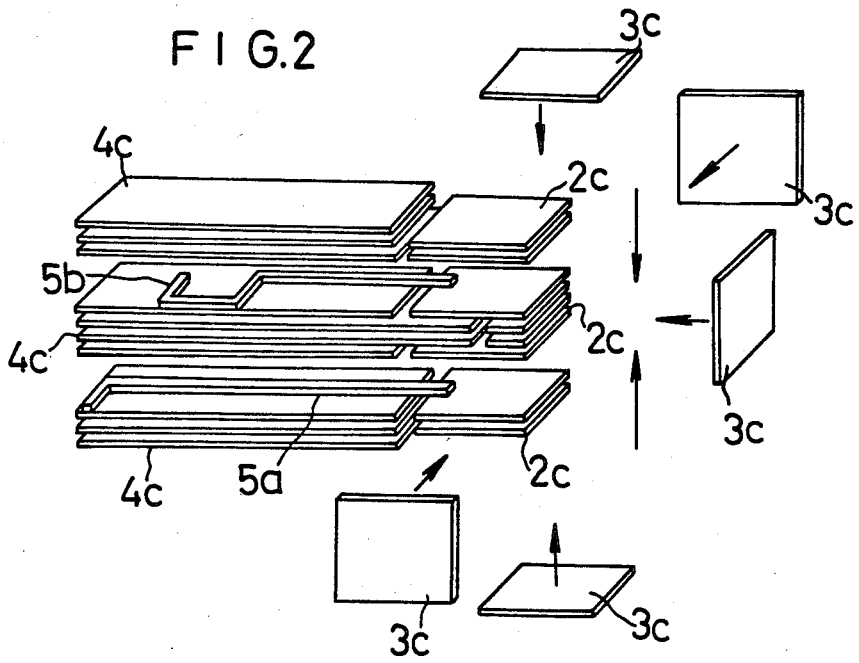
FIG. 2 is a view illustrating the producing method of a first embodiment of a ceramic heater according to the present invention.

These ceramic sheets 2*c*, 4*c* are arranged as shown in FIG. 2, and layered while sandwiching the lead wires 5*a*, 5*b* made of refractory metal such as molybdenum(Mo) and tungsten(W) as shown in FIG. 2.

Then, the whole outer surface of the layered conductive ceramic sheets 2*c* are covered with insulating ceramic sheets 3*c* which are prepared from $Si_3N_4$ by the same method as described above.

Then, these sheets 2*c*, 3*c*, 4*c* are incorporated in one body by hot pressing them at a temperature of about 100° C. under a pressure of 25 kg/cm$^2$. And the incorporated sheets 2*c*, 3*c*, 4*c* are sintered at a temperature of about 1600° C. under a pressure of 250 kg/cm$^2$.

As a result, the heater element 1 as shown in FIG. 1 is obtained.

In the obtained heater element 1, the resistance of the heat generator 2 is 0.18Ω while the coefficient of thermal expansion thereof is about $3.8\times10^{-6}$/°C. The coefficient of thermal expansion of the covering layer 3 is about $3.4\times10^{-6}$/°C. and that of the supporter 4 is substantially equal to that of the heat generator 2. And the porosity of the covering layer 3 is about 2%.

While the glow plug is used, the red-hot heat generator is exposed to light oil as a fuel.

Figure 3:
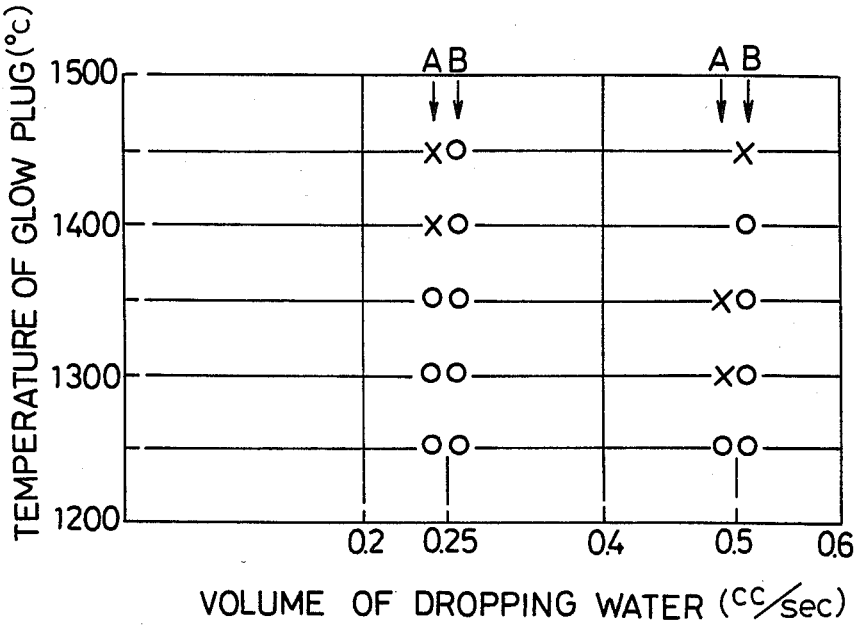
FIGS. 3, 4 and 5 are graphs showing the experimental results of the first embodiment, respectively.

FIG. 3 shows the experimental result of the occurrence of cracks in the heat generator 2. In this experiment, water droplets in place of light oil are dropped at the rate of 0.5 cc/sec. In FIG. 3, X shows the occurrence of cracks while O shows the nonoccurrence of cracks. The reference character A denotes the heater element of which the heat generator is uncovered with any covering layer while B denotes the heater element of the present invention, having a covering layer (thickness: 0.5 mm).

As is apparent from FIG. 3, cracks little occur in the heater element B of the present invention.

Figure 4:
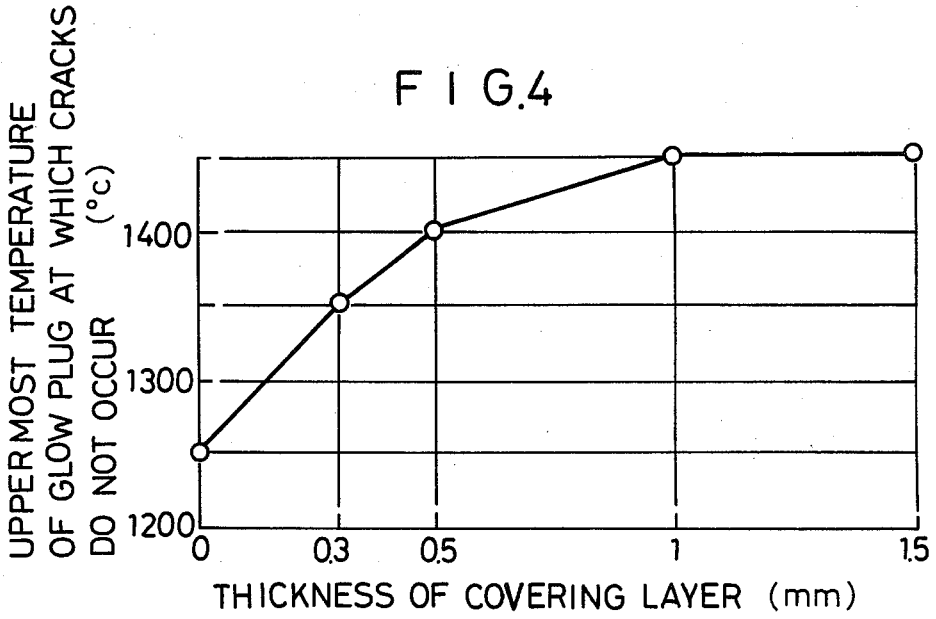
Figure 5:
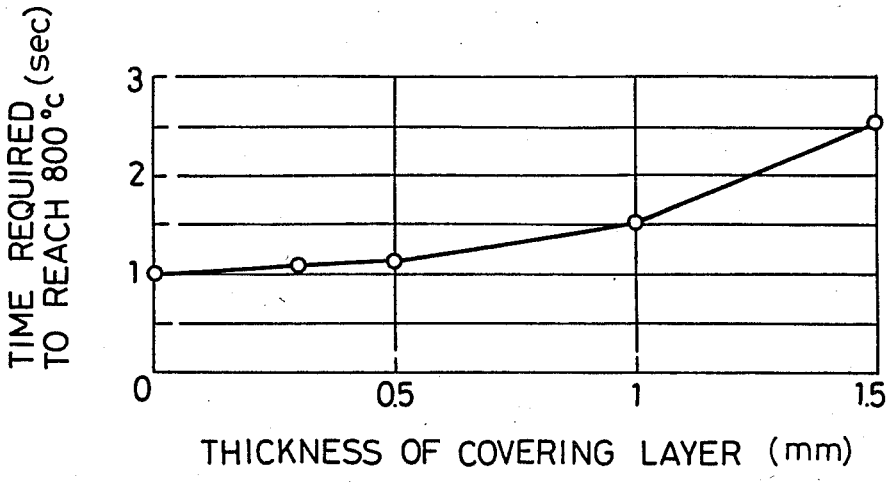

FIG. 4 shows the experimental result of the relation between the uppermost temperature of the glow plug, at which cracks do not occur in the heat generator of the present invention, and the thickness of the covering layer. And FIG. 5 is an experimental result of the relation between the time required until the temperature of the surface of the covering layer reaches 800° C. from the start of the application of an electric current to the heater element, and the thickness of the covering layer.

As the thickness of the covering layer increases, cracks become hard to occur in the heat generator and the time required until the surface of the covering layer reaches 800° C. becomes long.

The preferable thickness of the covering layer is about 0.3 mm to 1.0 mm from the viewpoint of the quick heating capacity and the cracks preventing effect of the covering layer.

Hereinafter, the second embodiment of the present invention will be explained.

In the second embodiment, the heat generator 2 of the heater element 1 of the glow plug shown in FIG. 1 is covered with a covering layer made of glass containing $SiO_2$ as a main constituent.

One example of the producing method of the heater element of the second embodiment will be explained.

Figure 6:
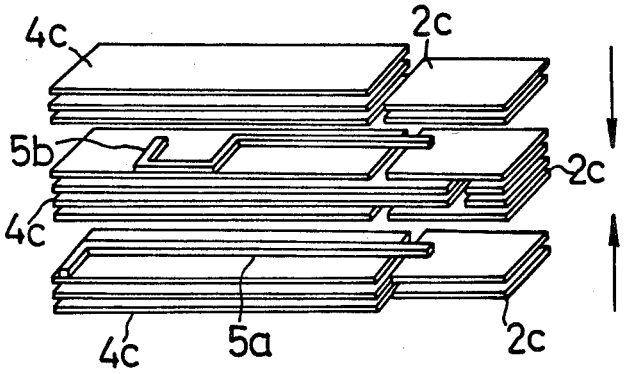
FIG. 6 is a view illustrating the producing method of a second embodiment of a ceramic heater according to the present invention.

At first, ceramic sheets 2*c*, 4*c* are prepared from the same materials by the same method as used in the first embodiment. Then, the ceramic sheets 2*c*, 4*c* and the lead wires 5*a*, 5*b* are assembled as shown in FIG. 6 and sintered under pressure by the same method as that of the first embodiment. Next, a covering layer made of glass including $SiO_2$ as a main constituent is formed on the outer surface of the obtained heat generator 2.

One example of the producing method of the glass covering layer will be explained.

A mixture of 80 mol% of silica($SiO_2$) and 20 mol% of borax($Na_2B_4O_7.10H_2O$) is heated to 1300° C. so as to be formed into borosilicate glass. The obtained borosilicate glass is cooled and pulverized into glass powder of an average particle diameter of about 0.001 mm. The obtained glass powder is kneaded with ethyl cellulose and terpineol into a paste. The obtained paste is applied to the surface of the obtained heat generator 2 and is dried. Next, the covering layer is heated to 1100° C. to sinter the glass powder thereof. Then, the covering layer is heat treated at 800° C. so as to split the $SiO_2$ rich phase, and $Na_2O$ and $B_2O_3$ rich phase from one another. After being cooled, the covering layer is treated with a hydrochloric acid bath to dissolve $Na_2O$ and $B_2O_3$. As a result, the material of the covering layer is transformed into porous glass with high $SiO_2$ content (more than 98 mol%). This covering layer is heat-treated at 1300° C. so as to be transformed into compactly sintered product. The porosity of the obtained high $SiO_2$ contained glass is about 1%.

Hereinafter, the experimental results of the heater element of the glow plug, which is produced by the above described method will be shown.

By passing an electric current to glow plugs each having a heat generator covered with a glass covering layer (thickness: 0.01 mm) and glow plugs each having an uncovered heat generator, respectively, each glow plug is made generate heat to a predetermined temperature different from one another and maintain such temperature for three minutes.

Then, the heat generating portion of each heat generator is immersed into a water bath of a temperature of 20° C. and the temperature at which electric resistance of each heat generator increases by 10% of the initial electric resistance thereof, is examined.

The experimental result is shown in Table 1. In Table 1, X marks designate the not less than 10% of increase of resistance while O marks designate the less than 10% of increase of resistance.

TABLE 1

| | Temperature (°C.) | | | | | |
|---|---|---|---|---|---|---|
| | 450 | 500 | 550 | 600 | 650 | 700 |
| Heat Generator having no Covering Layer | O | O | X | X | X | X |
| Heat Generator having a Covering Layer | O | O | O | O | O | X |

As is apparent from Table 1, the resistance of the heat generator having no glass covering layer, increases by 10% at 550° C. Such increase of resistance of the heat generator is resulted from the occurrence of cracks therein. In contrast, the resistance of the heat generator having a glass covering layer increases only by not more than 10% until 650° C.

Table 2 shows the relation between the thickness of the glass covering layer and the increase of resistance of the heat generator. The experimental method is the same as that described above.

TABLE 2

| Thickness of Covering Layer (mm) | Temperature of Metal | | | | | |
|---|---|---|---|---|---|---|
| | 450° C. | 500° C. | 550° C. | 600° C. | 650° C. | 700° C. |
| 0 | o | o | x | x | x | x |
| 0.005 | o | o | o | x | x | x |
| 0.01 | o | o | o | o | o | x |
| 0.1 | o | o | o | o | o | x |
| 0.5 | o | o | o | o | o peel off | x |
| 1 | o | o | o | o peel off | x | x |

When the thickness of the glass covering layer is too small, the effect of moderating the temperature change of the heat generator occurring when it is immersed in the water becomes small to cause the occurrence of cracks in the heat generator.

When the thickness of the glass covering layer is too large, cracks occur within the covering layer so that the covering layer is easy to peel off from the heat generator.

The coefficient of thermal expansion of high $SiO_2$ contained glass is 5 to $9\times10^{-7}$/°C. while that of the heat generator is $4.4\times10^{-6}$/°C. So, there is a considerably large difference in coefficient of thermal expansion between high $SiO_2$ contained glass and the heat generator.

Therefore, if the thickness of the glass covering layer is too large, stress is liable to be produced within the covering layer when the covering layer is formed on the surface of the heat generator and cracks are liable to be produced while the covering layer due to a large temperature gradient between the outside surface and the inside surface thereof which occurs when the heat generator is immersed in the water. The preferable thickness of the glass covering layer is 0.005 mm to 0.5 mm.

Figure 7:
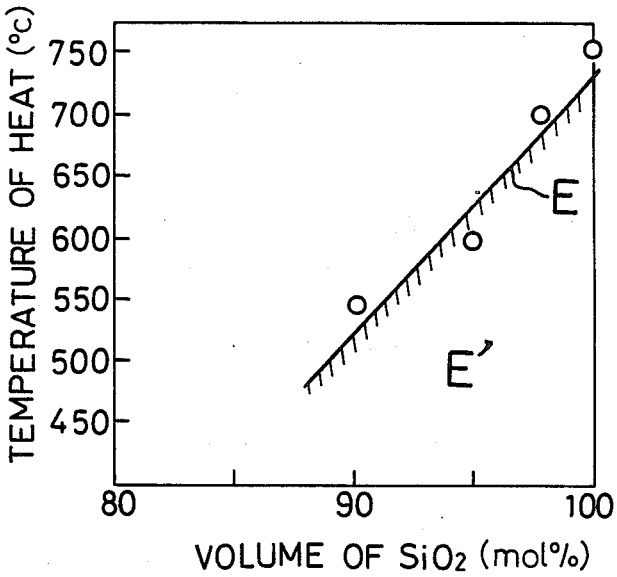
FIGS. 7 and 8 are graphs showing the experimental results of the second embodiment, respectively.

FIG. 7 shows the relation between the $SiO_2$ content within the glass covering layer and the resistance change of the heat generator.

In FIG. 7, in the range E' under the line E, the increase of electric resistance of the heat generator covered with the glass covering layer does not reach 10% when the heat generator is immersed in the water.

The preferable $SiO_2$ content of the glass covering layer of the heat generator to be used as a glow plug for a diesel engine, is not less than 95 mol%.

Figure 8:
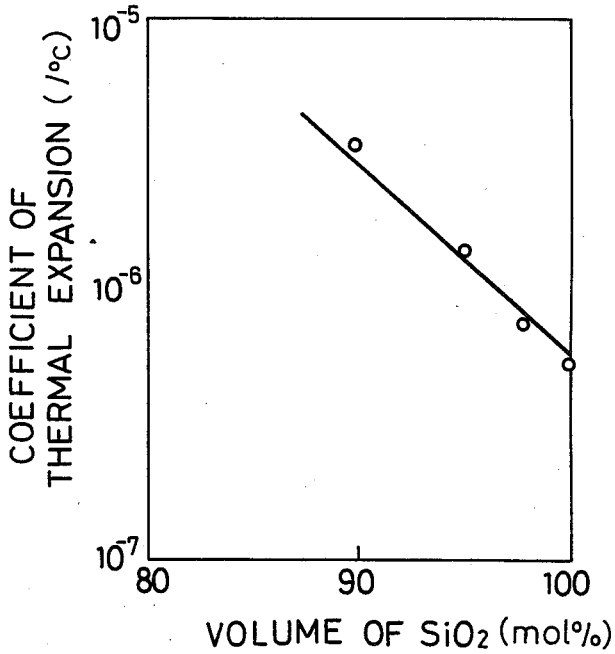

FIG. 8 shows the relation between the $SiO_2$ content with the glass covering layer and the coefficient of thermal expansion of the glass covering layer. As the $SiO_2$ content increases, the coefficient of thermal expansion decreases.

As described above, according to the present invention, by forming a thin insulating ceramic covering layer on the surface of a heat generator of a ceramic heater, the thermal shock resistance of the heat generator is largely improved without largely reducing the quick heating capacity of the ceramic heater.

The ceramic heater of the present invention can be effectively used as a heater used under severe conditions such as a heater for a glow plug of a diesel engine, of which the hot ceramic heat generator is exposed to low temperature light oil.

What is claimed is:

1. A ceramic heater comprising:

a heat generator made of a conductive ceramic sintered body;

a supporter made of an insulating ceramic sintered body for supporting said heat generator;

an unporous thin covering layer made of an insulating ceramic sintered body having a porosity of not more than 5% completely enclosing the outer surface of said heat generator, the covering ceramic layer preventing oxidation of said heat generator, improving the thermal shock resistance of said heat generator and preventing the heat generator from being directly exposed to water and oil;

said ceramic sintered bodies being secured together; and electric current supply means for supplying an electric current to said heat generator.

2. A ceramic heater according to claim 1, wherein said heat generator is integrally sintered with said supporter while said heat generator is integrally sintered with said covering layer.

3. A ceramic heater according to claim 2, wherein said conductive ceramic sintered body is made of a material selected from the group consisting of $MoSi_2$, TiO, TiN, a mixture of $Si_3N_4$ and one of $MoSi_2$, TiO, and TiN, and a mixture of $Al_2O_3$ and one of $MoSi_2$, TiO and, TiN.

4. A ceramic heater according to claim 2, wherein said insulating ceramic for forming said supporter is selected from the group consisting of $Si_3N_4$ and a mixture of $Si_3N_4$ and $Al_2O_3$.

5. A ceramic heater according to claim 2, wherein said insulating ceramic for forming said covering layer is selected from the group consisting of $Si_3N_4$, SiC, $ZrO_2$, BN, and a mixture of $Al_2O_3$ and one of $Si_3N_4$, SiC, $ZrO_2$, and BN.

6. A ceramic heater according to claim 2, wherein said insulating ceramic for forming said covering layer is glass containing $SiO_2$ as the main constituent.

7. A ceramic heater according to claim 2, wherein said electric current supply means comprises an electrode and a metallic wire for connecting said electrode to said heat generator; and said metallic wire is embedded within said supporter.

8. A ceramic heater according to claim 2, wherein said covering layer has a porosity of not more than 2%.

9. A ceramic heater according to claim 2, wherein said covering layer has a thickness of not more than 1 mm.

10. A ceramic heater according to claim 5, wherein said covering layer has a thickness of 0.3 to 1 mm.

11. A ceramic heater according to claim 6, wherein said covering layer has a thickness of 0.005 to 0.5 mm.

12. A ceramic heater according to claim 3, wherein said heat generator is made of a sintered body of a mixture composed of 50 to 95 mol% of $Si_3N_4$ with the remainder being $MoSi_2$.

13. A ceramic heater according to claim 12, wherein said $MoSi_2$ for forming said heat generator has an average particle diameter smaller than that of $Si_3N_4$.

14. A ceramic heater according to claim 6, wherein said glass for forming said covering layer contains not less than 95 mol% of $SiO_2$.

* * * * *